United States Patent [19]

Iwamoto

[11] 4,269,238

[45] May 26, 1981

[54] TOOTHPASTE EXTRUDER CAPABLE OF CONTROLLING THE SUPPLY AMOUNT

[76] Inventor: Masahiro Iwamoto, 358 Hiraoka-cho, Sakai-shi Osaka-fu, Japan

[21] Appl. No.: 61,756

[22] Filed: Jul. 30, 1979

[30] Foreign Application Priority Data

Apr. 24, 1979 [JP] Japan ..... 54-55539[U]

[51] Int. Cl.[3] ..... B65B 3/12

[52] U.S. Cl. ..... 141/362; 222/309

[58] Field of Search ..... 141/346–362, 141/1–12, 250–284; 222/309

[56] References Cited

U.S. PATENT DOCUMENTS

| | | | |
|---|---|---|---|
| 4,170,253 | 10/1979 | McArthur | 141/362 |
| 4,178,975 | 12/1979 | Crespi | 141/362 |

*Primary Examiner*—Houston S. Bell, Jr.

*Attorney, Agent, or Firm*—George B. Oujevolk

[57] ABSTRACT

A toothpaste extruder capable of automatically supplying a toothbrush with toothpaste extruded from a tube fixed to a suction port of the extruder through a reciprocating movement of an incorporated piston imparted by pressing a toothbrush to a toothbrush receiver provided on the housing of the extruder, the amount of supply being predeterminable so that the extrusion amount can be increased or decreased in conformity with the need of the user.

3 Claims, 6 Drawing Figures

TOOTHPASTE EXTRUDER CAPABLE OF CONTROLLING THE SUPPLY AMOUNT

The invention relates to a toothpaste extruder capable of increasing or decreasing the amount of supply wherein suction of toothpaste from a tube and supply of the toothpaste to a toothbrush are effected by a reciprocating movement of a piston, and more particularly to a toothpaste extruder capable of increasing or decreasing the amount of supply in conformity with the need of the user.

Conventionally, the automatic toothpaste extruder of the type described was generally adapted to supply a fixed amount of toothpaste extruded from the extruder. The conventional toothpaste extruder had a disadvantage in that, when the amount of extrusion was set so as to conform with the need of an adult, it was too large for a child, whereas when the amount was predetermined in conformity with the need of a child, the extruded amount of toothpaste was too small for an adult with the result that a second extrusion was necessitated.

The invention has for an object to provide a toothpaste extruder wherein the extruded amount of toothpaste is preliminarily contollable so that it can be increased or decreased in conformity with the need of the user.

Preferred embodiments of the invention will be described in detail hereinunder in reference to the accompanying drawings, in which.

Figure 1:
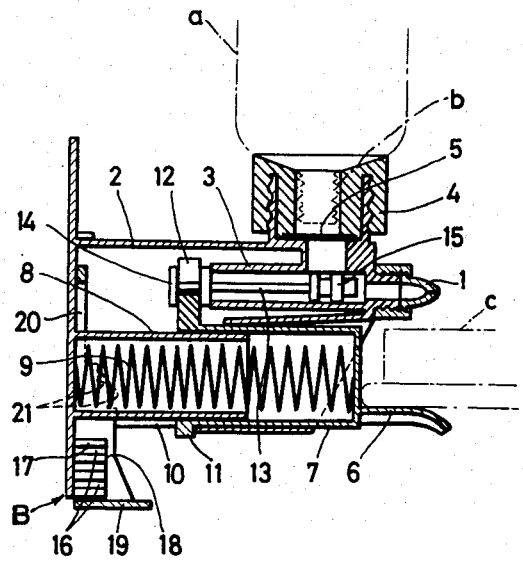
FIG. 1 is a longitudinal sectional side view showing an embodiment of a toothpaste extruder according to the invention.
Figure 4:
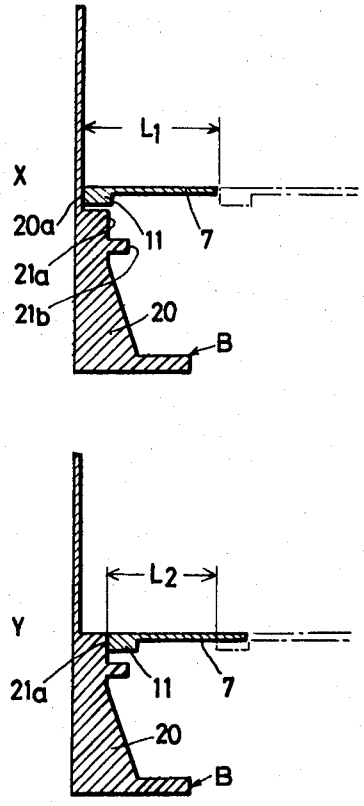
FIG. 4 shows how the extruded amount of toothpaste is increased or decreased.
Figure 2:
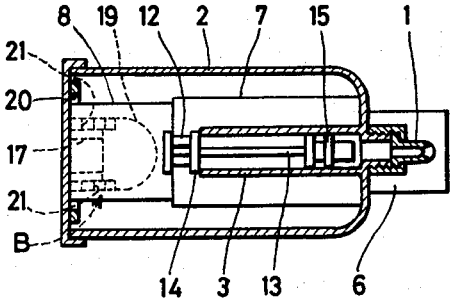
FIG. 2 is a cross-sectional plan view of the same.
Figure 3:
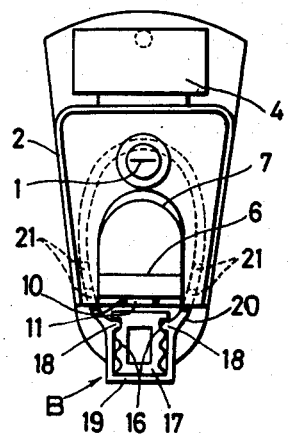
FIG. 3 is an elevational view of the same.

Referring to the drawings, the toothpaste extruder according to the invention is provided on one end thereof with a bill-shaped extrusion port 1 made of rubber which is adapted to open under extrusion pressure of toothpaste, though it is normally sustained in a blocked state. Inside a housing 2 there is provided a cylinder 3 integrally formed therewith.

On the upper face of the housing 2 there is provided a tube receiver 4 adapted to hold the neck (b) of the toothpaste tube (a) when inserted thereinto, a cylinder 3 and the tube receiver 4 being communicatable with each other with interposition of a suction valve 5.

The numeral 7 designates a slide tube abutting the forward end of a toothbrush (c), said slide tube 7 being integrally formed with the backside of an L-shaped toothbrush receiver 6 for supporting the backside of the head of the toothbrush. The numeral 8 designates a guide tube integrally formed with the housing 2, the slide tube 7 slidably fitting onto the guide tube 8. An expansion spring 9 is provided inside the slide tube 7 and the guide tube 8.

The slide tube 7 has a projection 11 engageable with a slide hold 10 formed in the bottom of the housing 2 thereby enabling to control the position of restitution of the slide tube 7, a piston rod 13 in the cylinder 3 being held by a U-shaped arm 12, said arm 12 being supported on both sides thereof by flanges 14, 14 secured to the piston rod 13 thereby enabling to cooperatively couple the slide tube 7 and the piston 15 with each other. The toothbrush receiver 6 is provided with a slide controller (B) capable of increasing or decreasing the intrusion length of the toothbrush. The slide controller (B), as shown in FIGS. 1 to 4, for example, comprises a supporting frame 17 integral with the housing 2 and provided with a plurality of locking recesses 16 on both sides thereof, and a control ring 20 made of an elastic soft synthetic resin. The control ring 20 is displaceable along the outside of the supporting frame 17, whilst it is stoppable with its inward projection 18 elastically fitting into a predetermined locking recess 16 of the supporting frame. A knob 19 is provided on the lower end of the control ring 20, whilst a terraced receiving face 21 is provided on the front face of the control ring 20. Thus, the position of the control ring 20 is adjustable by the knob 19 so that the projection 11 of the slide tube 7 abuts a predetermined part of the terraced receiving face 21 with the inward projection 18 engaging with one of the locking recesses 16 of the supporting frame.

The amount of extrusion of the toothpaste can be controlled by an increase or decrease of the length of restitution of the slide tube 7. The length of restitution of the slide tube varies depending on which one of the plurality of locking recesses provided on the supporting frame 17 engages with the inward projection 18. The mechanism will be described in more detail in reference to FIG. 4.

FIG. 4(X) shows the case when the inward projection 18 of the control ring 20 engages with a locking recess of the lower tier among the locking recesses 16 of the supporting frame 17. In this state, the slide tube 7 is slidable along the guide tube 8 if pushed forwardly against the expansion spring 9 with interposition of a toothbrush until the projection 11 of the slide tube abuts the receiving face 20*a* of the control ring 20, that is, a distance of L1. Thus, the piston 15 cooperating with the slide tube 7 slides by the distance of L1 thereby drawing the toothpaste from the tube (a) into the cylinder 3 by suction. To be more precise, if the piston is forwardly displaced by a distance of L1, toothpaste in the amount corresponding to the distance of L1 is sucked into and extruded from the cylinder 3 when the piston is released from the pressure of the toothbrush.

In the case of FIG. 4(Y), the inward projection 18 of the control ring 20 is engaged with a locking recess on the median tier among the locking recesses 16 of the supporting frame 17. Since the projection 11 of the slide tube 7 is displaceable until it abuts a receiving face 21*a* of the control ring 20, the piston 15 can travel a distance of L2. In this case, therefore, toothpaste in the amount corresponding to the distance of L2 is sucked into and extruded from the cylinder 3.

FIG. 4(Z) shows a case in which the inward projection of the control ring 20 is engaged with a locking recess on the upper tier among the locking recesses 16 of the supporting frame 17. The projection 11 of the slide tube 7 is displaceable until it abuts a receiving face 21*b* of the control ring 20 thereby enabling the piston 15 to travel a distance of L3. Thus, toothpaste in the amount corresponding to the distance of L3 is sucked into and extruded from the cylinder 3. The distance, L1, L2 and L3 have an interrelation of $L1>L2>L3$. Accordingly, the amount of toothpaste to be used can be preliminarily set, for example, L1 for the adult, L3 for a child, and the like.

The operation of the toothpaste extruder according to the invention will now be described in detail.

If a toothbrush (c) upwardly placed on the toothbrush receiver 6 is pushed forwardly, the slide tube 7 slides along the guide tube 8 whilst compressing the extension spring 9. Since the U-shaped arm 12 integral with the slide tube 7 is in engagement with the piston 15, the slide tube 7 and the piston 15 cooperate with each other, toothpaste being drawn from the tube (a) into the cylinder 3 by suction. Then, if the toothbrush receiver 6 is released from the pressure, the slide tube 7 is retrieved by the resilience of the expansion spring 9, the piston 15 pressing the toothpaste inside the cylinder 3 thereby blocking the suction valve 5 whilst opening the extrusion port 1, a ribbon of toothpaste being extruded on the toothbrush according as it is retrieved together with the toothbrush receiver 6, the slide tube 7 being brought to a stop with its lower projection 11 abutting one end of the slide hole 10.

As described hereinbefore, under the pressure of the toothbrush receiver 6, the slide tube 7 slides whilst compressing the expansion spring 9 until it is brought to a stop with its projection 11 abutting the terraced receiving face 21. Since the abutting position of the projection 11 on the terraced receiving face 21 is variable by changing the locking position of the locking recesses 16 with which the inward projection 18 engages, as described in reference to FIG. 4, the stroke of the piston 15 can be controlled accordingly thereby enabling to increase or decrease the amount of extrusion of the toothpaste. If the position of the terraced receiving face 21 is preliminarily adjusted by means of the knob 19 in accordance with the need of the user or the size of the toothbrush (c), a required amount of toothpaste is extruded with simplicity and reliability thereby enabling to supply the toothbrush with toothpaste in the amount most suitable for the user without the trouble of insufficient or excessive supply.

Figure 5:
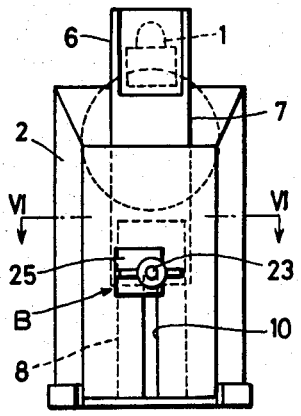
FIG. 5 is a bottom view of a toothpaste extruder showing another embodiment of the invention.
Figure 6:
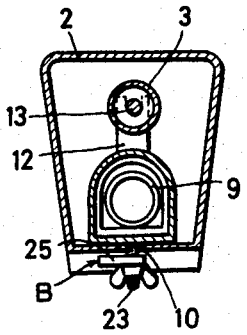
FIG. 6 is a sectional view taken along the line VI—VI of FIG. 5.

The mechanism of the slide controller (B) is not restricted to that of the aforementioned embodiment. For example, the projection 11 of the slide tube 7 may be replaced by a projecting shaft 23, a cam 25 being rotatably mounted on said shaft 23, as shown in FIGS. 5 and 6. The length of the cam 25 from the axis of the projecting shaft 23 to the circumference varies by stages. If the slide tube 7 is pushed inwardly until it abuts the backside of the housing 2 after the length from the projecting shaft to the periphery of the cam has been preliminarily set, the sliding length of the slide tube can be controlled in conformity with the predetermined length of the cam 25, whereby the amount of extrusion of the toothpaste can be increased or decreased as in the case of the embodiment of FIG. 4.

As described hereinbefore with reference to each of the embodiments, the toothpaste extruder according to the invention enables to control the extrusion amount in conformity with the need of the user.

What is claimed is:

1. A toothpaste extruder capable of controlling the amount of supply comprising:

(a) a bill-shaped extrusion port made of rubber which is provided on one end of the housing and normally sustained in a blocked state;

(b) a suction valve through which a cylinder integrally formed with the housing communicates with a tube receiver for supporting the neck of a toothpaste tube;

(c) an L-shaped toothbrush receiver abutting the forward end of a toothbrush and supporting the backside of the part of the toothbrush where bristles are planted, said toothbrush receiver having a slide tube formed on the backside thereof;

(d) a guide tube secured to the housing so as to slidably fit into the slide tube of the toothbrush receiver;

(e) an expansion spring provided in the slide tube and the guide tube;

(f) a projection provided in the lower part of the slide tube so as to control the restitution position thereof by engaging with a slide hole formed in the bottom of the housing;

(g) flanges of the slide tube secured to one end of the piston rod so that the slide tube and the piston in the cylinder cooperate with each other; and (h) a slide controller for controlling the intrusion length of the toothbrush receiver.

2. A slide controller as defined in claim 1 comprising a plurality of locking recesses provided on both sides of a supporting frame integrally formed with the housing, and a control ring made of an elastic soft synthetic resin independently of the supporting frame, which is displaceable along the outside of the supporting frame and provided with an elastic inward projection for stoppage by fitting into a locking recess of the supporting frame, wherein the control ring has a terraced receiving face, the position of the control ring being adapted to be determinable by the position of engagement between the inward projection and the locking recess of the supporting frame so that the projection of the slide tube may abut the required one of the terraced receiving faces.

3. A slide controller as defined in claim 1 wherein the projection of the slide tube is replaced by a projecting shaft, on the projecting shaft being rotatably mounted a cam of which the length from the axis to the periphery varies by stages thereby enabling to control the intrustion length of the slide tube by predetermining the length from the axis of the projecting shaft to the periphery of the cam.

* * * * *